US008746129B2

(12) United States Patent
Yonezawa

(10) Patent No.: US 8,746,129 B2
(45) Date of Patent: Jun. 10, 2014

(54) RODLESS CYLINDER

(75) Inventor: Tsuyoshi Yonezawa, Kiyosu (JP)

(73) Assignee: Howa Machinery, Ltd., Kiyosu (JP)

( * ) Notice: Subject to any disclaimer, the term of this patent is extended or adjusted under 35 U.S.C. 154(b) by 858 days.

(21) Appl. No.: 12/989,634

(22) PCT Filed: Apr. 27, 2009

(86) PCT No.: PCT/JP2009/058652

§ 371 (c)(1),
(2), (4) Date: Oct. 25, 2010

(87) PCT Pub. No.: WO2009/139324

PCT Pub. Date: Nov. 19, 2009

(65) Prior Publication Data

US 2011/0041683 A1 Feb. 24, 2011

(30) Foreign Application Priority Data

May 12, 2008 (JP) ..... 2008-124907

(51) Int. Cl.
*F15B 15/08* (2006.01)

(52) U.S. Cl.
USPC ..... 92/88

(58) Field of Classification Search
USPC ..... 92/88
See application file for complete search history.

(56) References Cited

U.S. PATENT DOCUMENTS 2,200,427 A * 5/1940 Merz ..... 92/88
6,092,456 A * 7/2000 Noda et al. ..... 92/88

FOREIGN PATENT DOCUMENTS

| | | |
|---|---|---|
| JP | 05-118303 | 5/1993 |
| JP | 08-135610 | 5/1996 |
| JP | 11-002208 | 1/1999 |
| JP | 11-294412 | 10/1999 |
| JP | 2000-257605 | 9/2000 |
| JP | 3590966 | 9/2004 |

* cited by examiner

*Primary Examiner* — F. Daniel Lopez

(74) *Attorney, Agent, or Firm* — Finnegan, Henderson, Farabow, Garrett & Dunner, L.L.P.

(57) ABSTRACT

In a rodless cylinder 1, a band accommodating depression 60 having a transverse inner surface 62 extending along the width of a slit 12 of an inner hole 10 of a tube 2 and a wall surface 64 inclined with respect to the transverse inner surface 62 is formed on each side of the inner opening of the slit 12. In the case where one of the edges of the inner seal band 42 comes into contact with one of the wall surfaces 64, the other edge of the inner seal band 42 comes into contact with the other one of the transverse inner surfaces 62, while at the same time securing a distance I between the inner seal band 42 and an inner opening 58 of the slit 12. Once a fluid is introduced into the tube 2, the inner seal band 42 can be bent toward the slit 12 due to the distance I even in the case where one of the edges of the inner seal band 42 comes into contact with the transverse inner surface 62 and the other edge comes into contact with the wall surface 64. As a result, a rodless cylinder is provided in which by forming transverse walls and preventing the seal band from being displaced by more than a predetermined amount, the slit is accurately sealed and the moving unit can be positively moved.

2 Claims, 6 Drawing Sheets

RODLESS CYLINDER

TECHNICAL FIELD

This invention relates to a rodless cylinder with a moving unit operated under a fluid pressure.

BACKGROUND ART

The conventional rodless cylinder described in Patent Document 1 cited below is known. This rodless cylinder includes a cylinder tube (tube) having a longitudinal slit, and a moving unit adapted to move along the slit. The moving unit has an inner tube portion and an outer slit portion, and is moved with the inner tube portion being pressed by the fluid.

This conventional rodless cylinder further includes an inner seal band extended along the slit to close the slit from inside the inner hole of the tube. The longitudinal ends of the inner seal band are restricted, and the intermediate portion of the inner seal band is passed through a passage groove formed on the inner tube portion. As a result, the fluid can act on the inner tube portion without leaking in spite of the presence of the slit. This rodless cylinder has a wear-resistant thin-plate slide contact member of synthetic resin on each side of the passage groove, so that the transverse (crosswise) displacement of the inner seal band is prevented. Thus, the situation, in which the inner seal band is displaced to release the fluid, is prevented from occurring.

PRIOR ART DOCUMENTS

Patent Document

PATENT DOCUMENT 1: Patent Publication No. 3590966

SUMMARY OF THE INVENTION

Problem To Be Solved By The Invention

In this rodless cylinder, the fluid is not required to be released by pressing the inner seal band against the inner surface of the tube, and therefore, the edges on both sides of the inner seal band are thin and sharp. Therefore, even in the case where a wear-resistant material is used for the slide contact member, the inner seal band may cut into the slide contact member to produce dust or may be transversely displaced. Also, even though the two sides of the inner seal band are restricted by the slide contact members, transverse displacement may still occur in the case where the inner seal band is tilted by the moment acting thereon.

Accordingly, the object of this invention is to provide a rodless cylinder in which the inner seal band is prevented from being displaced more than a predetermined amount so that the slit is accurately sealed and the moving unit is positively moved.

Means for Solving the Problem

In order to achieve the object described above, according to a first aspect of the invention, there is provided a rodless cylinder comprising:

a cylinder tube including an inner hole, the cylinder tube being formed of an inner hole and a slit parallel to the length of the cylinder tube and communicating with the inner hole;

an inner moving unit arranged in the inner hole of the cylinder tube and movable along the length of the cylinder tube;

an outer moving unit arranged on the outside of the cylinder tube and coupled to the inner moving unit by a connector extending through the slit; and an inner seal band extending along the slit to close the slit from inside the inner hole;

wherein longitudinal ends of the inner seal band are restricted so that the inner moving unit passes through an intermediate portion of the inner seal band wherein a band accommodating depression having a transverse inner surface substantially extending in a direction of a width of the slit and a wall surface inclined at an angle to the transverse inner surface is formed on each side of an inner opening of the slit;

wherein the cross section of each of the transverse inner surfaces is an arcuately curved surface with the center of curvature located at a position nearer to a center of the slit;

wherein the band accommodating depressions are formed in such a manner that in the case where one of transverse end portions of the inner seal band comes into contact with one of the wall surfaces, the transverse end portion of the other inner seal band comes into contact with the other transverse inner surface and the inner seal band and the inner opening of the slit are in predetermined spaced relation with each other; and wherein the fluid introduced into the cylinder tube with the slit enclosed by the inner seal band acts on the inner moving unit thereby to move the inner moving unit.

According to the first aspect of the invention, even in the case where the fluid is introduced and one of the transverse end portions of the inner seal band comes into contact with the transverse inner surfaces while the other transverse end portion thereof comes into the corresponding wall surface, the inner seal band is not displaced any more and the moving unit can be positively moved while sealing the slit accurately. Further, under this condition, the inner seal band can be bent toward the slit in a predetermined range.

According to a second aspect of the invention, each of the wall surfaces is formed as a slope located farther from the center line of the slit, the nearer the center of the cylinder tube. As a result, even in the case where the inner seal band is displaced under the moment acting on the inner seal band, the edge can be positively received thereby to prevent the wearing of the band accommodating depression and the edge including the wall surface.

According to a third aspect of the invention, in case the inner seal band is displaced transversely and the transverse end portion comes into contact with the corresponding wall surface, the particular wall surface has a sufficient inclination angle and length to prevent the transverse end portion from riding over the wall surface. Therefore, a simple configuration can be realized while at the same time making it possible for the band accommodating depression to work effectively.

Effects Of The Invention

According to this invention, a wall surface is formed in a band accommodating depression wider than an inner seal band to permit the edge of the inner seal band to be received. Also, the distance is set in such a manner that the inner seal band can be bent toward the slit even if the wall surface receives the edge. As a result, the transverse displacement of the inner seal band can be limited within a range posing no hermeticity problem, and the moving unit can be accurately moved.

These and other objects, features and advantages of the invention will be made more apparent by the detailed description of typical embodiments of the invention taken in conjunction with the accompanying drawings.

MODE FOR CARRYING OUT THE INVENTION

Examples of embodiments of the invention (first and second embodiments and modifications thereof) are explained below with reference to the drawings. Incidentally, these embodiments are not limited to the examples described below.

<First Embodiment>

[Configuration, Etc.]

Figure 1:
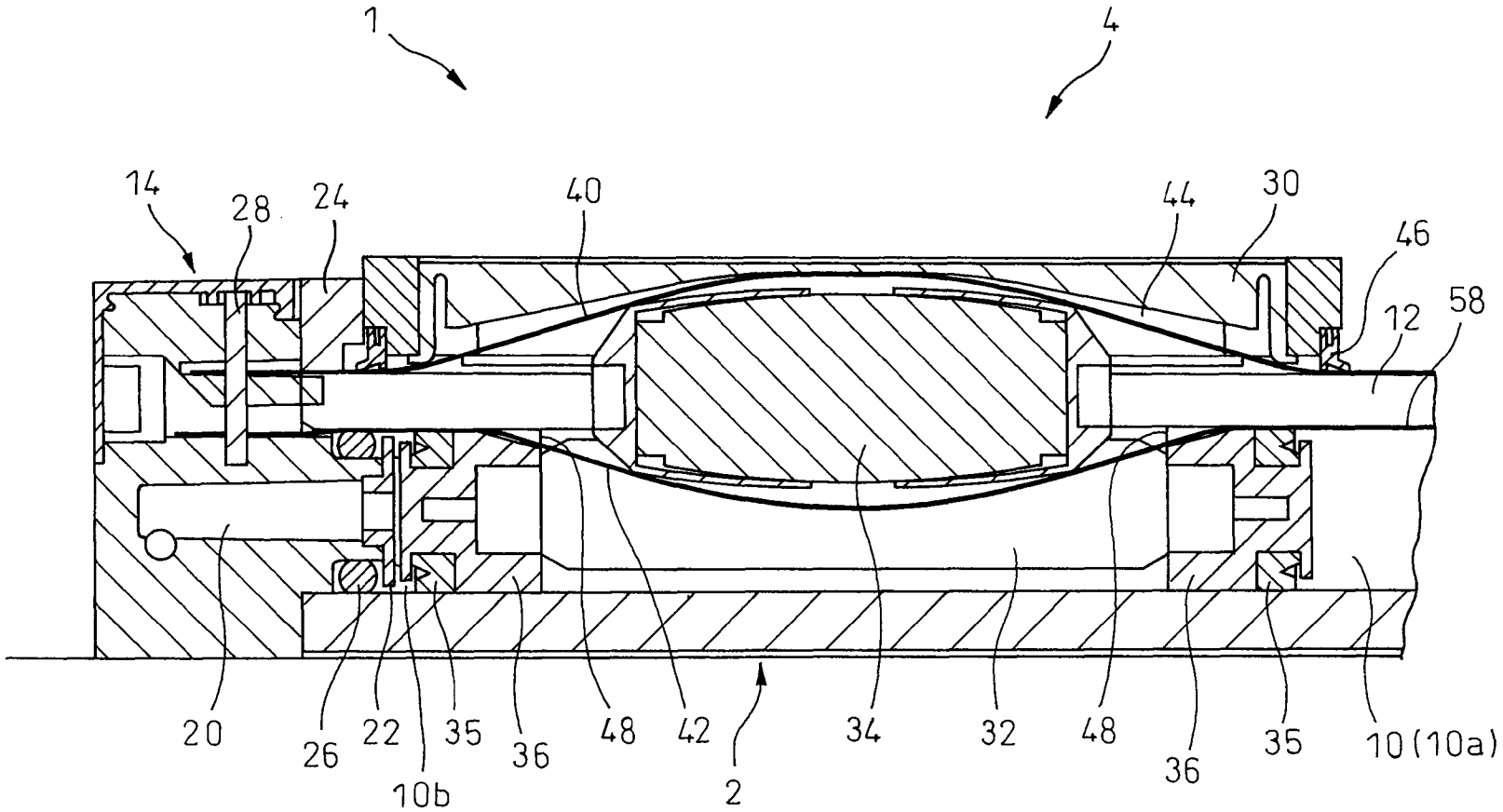
FIG. 1 is partially-omitted longitudinal sectional view taken at the transverse center of a rodless cylinder 1 according to a first embodiment of the invention.
Figure 2:
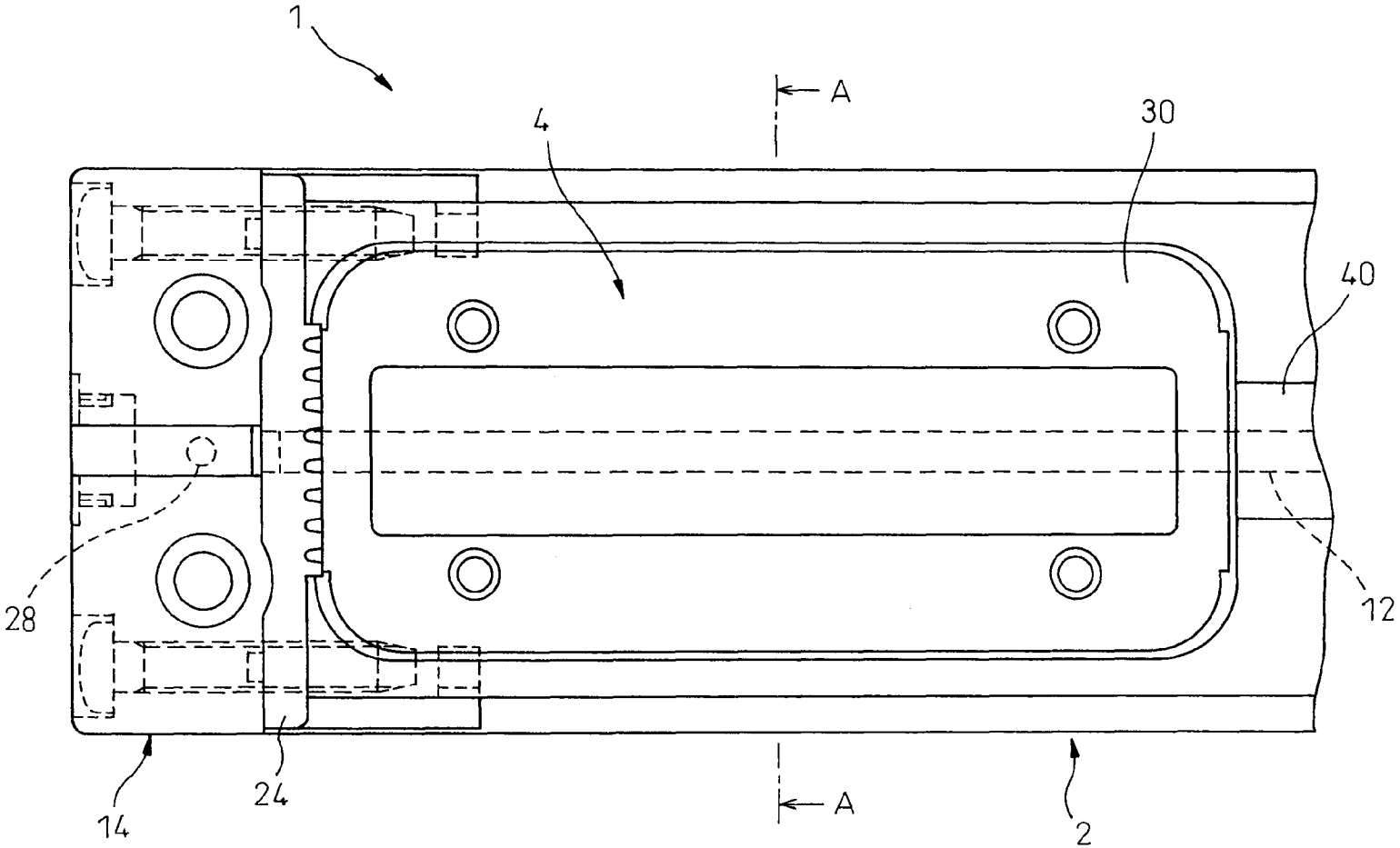
FIG. 2 is a plan view of FIG. 1.
Figure 3:
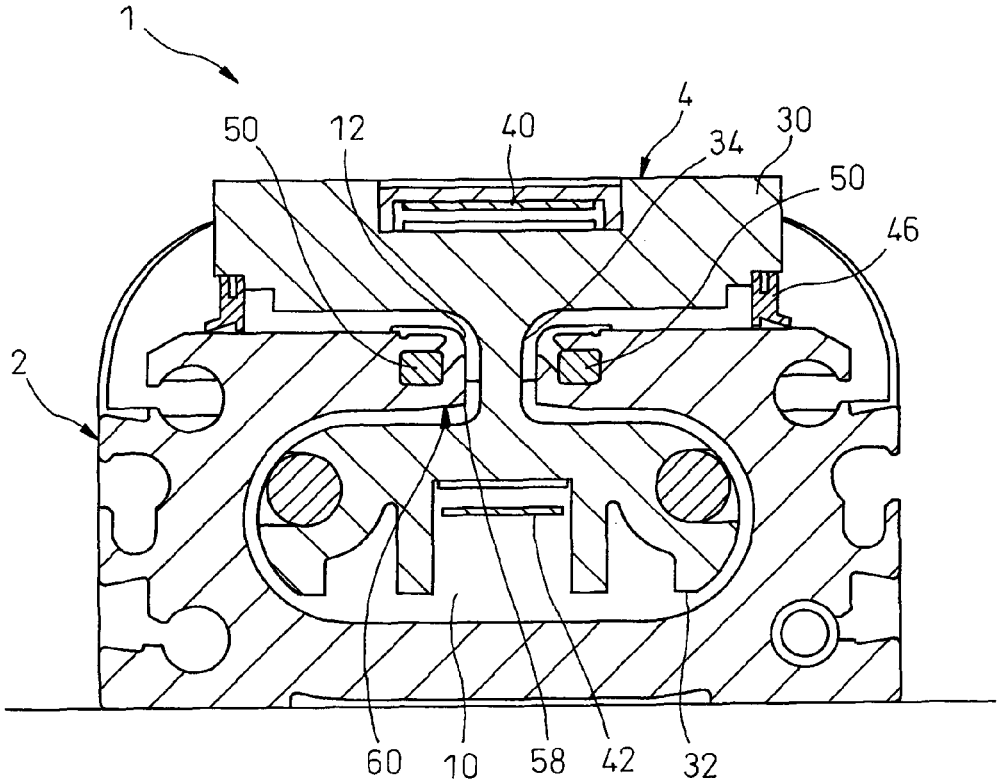
FIG. 3 is a sectional view taken in line A-A in FIG. 2.

FIG. 1 is partially-omitted longitudinal sectional view taken at the transverse center of a rodless cylinder 1 according to a first embodiment of the invention. FIG. 2 is a plan view of FIG. 1. FIG. 3 is a sectional view taken in line A-A in FIG. 2. A rodless cylinder 1 includes a long cylinder tube (hereafter sometimes referred to simply as the tube) 2 and a moving unit 4 adapted to move along the tube 2. Incidentally, in the description that follows, the transverse direction is defined as the lateral direction, and the direction along the length as the longitudinal direction. Further, in FIG. 2, the upward direction is defined as the left direction and the right direction as the forward direction.

The tube 2 includes an oblong inner hole 10 with the cross section surrounded by a semiarc and a horizontal line and an upper slit 12 formed along the longitudinal direction. The slit 12 communicates with the upper portion of the inner surface of the inner hole 10. An end cap 14 for closing the inner hole 10 is arranged at each of the front and tail ends of the tube 2 (only the end cap at the tail end is shown in the diagrams and in the description that follows, and the end cap at the other end is arranged symmetrically with respect to the tail-end cap). Each of the end caps 14 is connectable to a fluid supplier/discharger not shown, and includes an inlet/outlet hole 20 communicating with the inner hole 10 of the tube 2, an inner damper 22 constituting an annular elastic member arranged on the inner hole 10 side of the inlet/outlet hole 20 and an outer damper 24 constituting a block-like elastic member arranged on the moving unit 4 side of the inner damper 22 above the latter.

The moving unit 4 includes a table-like outer portion 30, an inner portion (piston) 32 with a partially oblong section, and a connector 34 for connecting the outer portion 30 and the inner portion 32 (integrally with each other). The inner portion 32 is somewhat smaller than and arranged in the inner hole 10 of the tube 2. The connector (piston yoke) 34 has a thickness somewhat smaller than the width of the slit 12 of the tube 2 and arranged inside the slit 12. The side portion 30 is arranged above (the slit 12 of) the tube 2.

A piston end 36 having a surrounding piston packing 35 is arranged at each of the front and tail end portions of the inner portion 32. Each piston packing 35 is formed of an elastic material, and in close contact with the peripheral wall of the inner hole 10 of the tube 2, divides the inner hole 10 into a cylinder chamber 10*a* before the moving unit 4 and a cylinder chamber 10*b* after the moving unit 4. Incidentally, the end cap 14 at each of the front and tail ends of the tube 2 has an elastic annular end packing 26 for hermetically closing the end portion of the inner hole 10 around the inlet/outlet hole 20.

Furthermore, an outer seal band 40 having a length equal to that of the tube 2 and a width larger than that of the slit 12 is arranged above the slit 12 of the tube 2. An inner seal band 42 formed similarly to the outer seal band 40 is arranged under the slit 12. The outer seal band 40 and the inner seal band 42 are each a thin flat metal band which, in the case under consideration, has edges (left and right side edges and transverse edges) thinner than the central portion. The front and tail ends of each of the outer seal band 40 and the inner seal band 42 are fixed on the end cap 14 via a common pin 28.

An outer band passage portion 44 formed in the longitudinal direction is arranged at the transverse central portion of the outer portion 30 of the moving unit 4. The outer band passage portion 44 is curved upward in longitudinal direction and guides the outer seal band 40. Furthermore, a scraper 46 formed of an elastic material in the shape of a rectangular frame is fitted around the lower portion of the outer portion 30. The scraper 46 is in contact slidably with the outer upper surface of the tube 2. The longitudinally central portion of the scraper 46 is in slidable contact with the upper side of the outer seal band 40, and the scraper 46 extends the outer seal band 40 in such a manner as to cover the upper side of the slit 12 along the upper side of the slit 12 before and after the outer portion 30.

On the contrary, an inner band passage portion 48 is arranged on the inside of the upper central portion of each piston end 36 on the inner portion 32 of the moving unit 4. The central lower portion of each inner band passage portion 48 or the inner portion 32 is curved downward in longitudinal direction and guides the inner seal band 42. The inner band passage portion 48 and the piston packing 35 of each piston end 36 press the inner seal band 42 against the lower side of the slit 12 or the upper surface of the inner hole 10, and extends the inner seal band 42 in such a manner as to cover the lower side of the slit 12 along the lower side of the slit 12 before and after the moving unit 4. Incidentally, a magnetic member 50 is arranged along the slit 12 inside the left and right sides of the slit 12 of the tube 2. Each magnetic member 50 adsorbs the outer seal band 40 or the inner seal band 42 before and after the moving unit 4.

Figure 4:
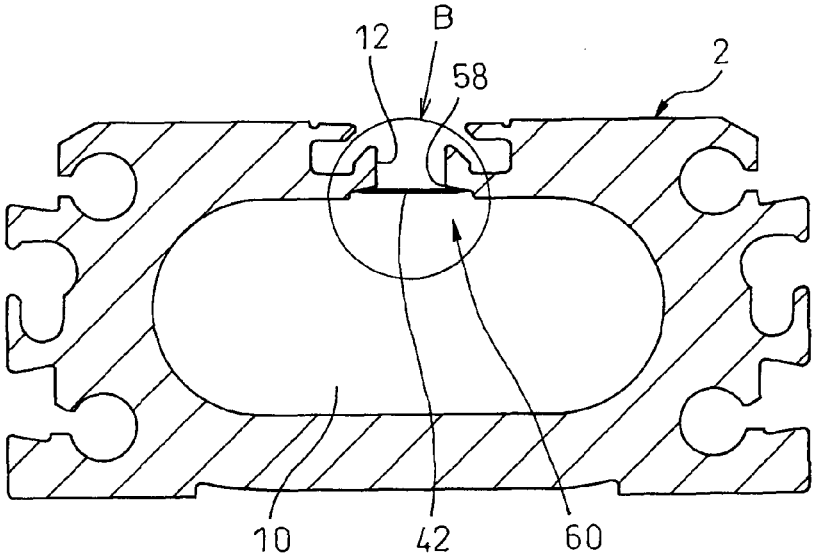
FIG. 4 is a sectional view taken along the width of a tube in FIG. 1.
Figure 5:
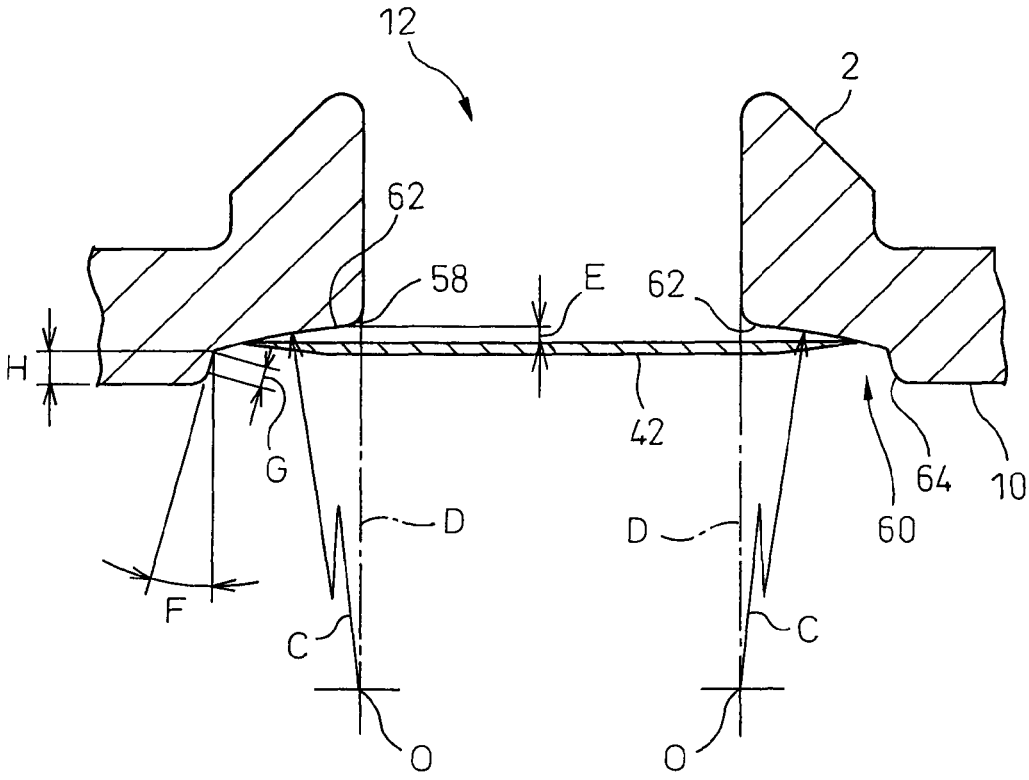
FIG. 5 is an enlarged view of a part B in FIG. 4.

FIG. 4 shows a transverse sectional view of the tube 2, and FIG. 5 an enlarged view of the part B in FIG. 4. A band accommodating depression 60 for receiving the inner seal band 42 is formed on each side of the inner opening 58 of the slit 12 of the inner hole 10. The band accommodating depression 60 is formed in longitudinal direction along the two lower sides of the slit 12, and constitutes a step depressed upward on the other inner surface of the inner hole 10. The band accommodating depression 60 communicates with the slit 12, or more specifically, the surface of the slit 12 and the surface of the band accommodating depression 60 (the transverse inner surface 62 described below) are continuously integrated with each other.

The band accommodating depression 60 includes each of transverse inner surfaces 62 at an acute angle to the inner seal band 42 and a wall surface 64 at an obtuse angle to the inner seal band 42 outside each transverse inner surface 62.

Each transverse inner surface 62 constitutes a curved surface having an arcuate section of a large radius of curvature C with the center O thereof located at a position nearer to the corresponding transverse inner surface 62 than the vertical surface containing the center line of the slit 12 or, for example, at a position inside the plane D containing the surface constituting the slit 12. The total width of the two transverse inner surfaces 61 and the slit 12 is larger than the width of the inner seal band 42. As long as the center of the inner seal band 42 coincides with the center of the slit 12, the distance E is (slightly) formed between the inner seal band 42 and the inner opening 58 of the slit 12 (the boundary between the surface constituting the slit 12 and the transverse inner surface 62).

Figure 6:
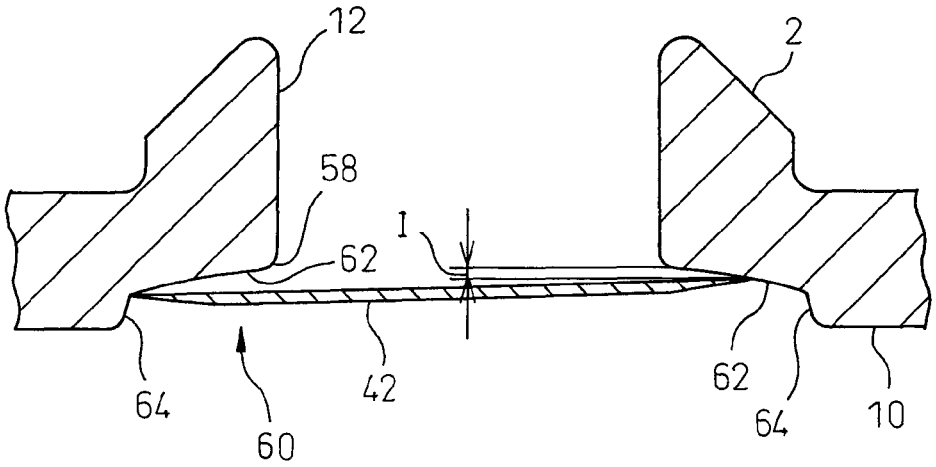
FIG. 6 is a diagram corresponding to FIG. 5 in the case where an edge of an inner seal band is received by the wall surface of a band accommodating depression.

Each wall surface 64 crosses the corresponding transverse inner surface 62, and forms a slope at an inclination angle F (say, 15 degrees) with respect to the vertical surface (the surface constituting the slit 12). Each wall surface 64 is formed as a slope farther from the center line of the slit 12, the nearer to the central side (lower side) of the tube 2. Furthermore, each wall surface 64 has a predetermined slope length G from the crossing line of the transverse inner surface 62 and a predetermined rise amount H (height). Each wall surface 64 is formed in such a manner as to receive the transversely-displaced edge of the inner seal band 42 not to be ridden over by the inner seal band 42 (see FIG. 6). The band accommodating depression 60 is formed in such a manner that while the wall surface 64 receives one edge of the inner seal band 42, the distance I is secured (slightly) between the other edge of the inner seal band 42 and the inner opening 58 of the slit 12. The distances E, I are set in accordance with the amount of bending of the inner seal band 42 toward the slit 12 under the fluid pressure.

The distance between the wall surfaces 64 (the crossing lines with the transverse inner surfaces 62) is larger than the width of the slit 12. This distance is determined substantially in the case where one edge of the inner seal band 42 reaches the wall surface 64, the other edge thereof remains on the transverse inner surface 62 (the other edge remains without coming off from the slit 12). The distance between the wall surfaces 64 is also determined in such a manner as to permit the inner seal band 42 to be transversely displaced to a degree not to come off.

[Operation, Etc.]

The moving unit 4 of the rodless cylinder 1 is moved longitudinally under the pressure of a fluid such as the air. An explanation is given below about the operation of moving the moving unit 4 forward by introducing the fluid from the piston end 14 after the tube 2. The moving unit 4 can be moved backward similarly by a symmetric operation.

The fluid is introduced first into the inlet/outlet hole 20 by a fluid absorber/discharger not shown. Then, the fluid enters the cylinder chamber 10*b* behind the moving unit 4. The cylinder chamber 10*b* is formed hermetically by the piston end 36 having an end packing 26 and a piston packing 35 or an inner seal band 42 and an outer seal band 40. The pressure of the fluid that has entered the cylinder chamber 10*b* acts mainly on the piston end 36 of the inner portion 32 of the moving unit 4 and drives the moving unit 4 forward.

The piston end 36 can be moved by sliding back and forth even in hermetic contact with the inner hole 10. As the result of movement, the outer band passage portion 44 receives the front portion of the outer seal band 40 sequentially, while at the same time sending out the rear portion of the outer seal band 40, that has been received, backward. The scraper 46 presses the outer seal band 40 downward under the weight of the outer portion 30, so that the portions of the outer seal band 40 before and after the scraper 46 come into contact with the upper portion of the slit 12 and the outer upper surface of the tube 2 around the slit 12. On the contrary, with the movement of the piston end 36, each inner band passage portion 48 receives the front portion of the inner seal band 42 sequentially, while at the same time sending out, backward, the rear portion of the inner seal band 42 that has been received. Each piston end 36 guides the inner seal band 42 downward, so that the inner seal band 42 before and after each piston end 36 comes into contact with the lower portion of the slit 12 and the inner upper surface of the tube 2 around the slit 12.

The hermeticity of the cylinder chamber 10*b* is not changed by the forward movement of the moving unit 4, and therefore, the moving unit 4 can be moved further forward under the fluid pressure. Specifically, the hermeticity of the piston end 36 is held by the piston packing 35 also after movement, and so is the hermeticity of the slit 12 enclosed in double ways, up and down, behind the moving unit 4 by the inner seal band 42 and the outer seal band 40. Incidentally, once the moving unit 4 reaches the most forward point, the front side of the outer portion 30 comes into contact with the outer damper 24 and so does the piston end 36 into contact with the inner damper 22, thereby stopping the moving unit 4.

The inner seal band 42 (those portions of the moving unit 4 other than the portion between the inner band passage portions 48) is accommodated in the band accommodating depression 60, and the transverse displacement thereof is suppressed within a set amount. Specifically, in the case where the inner seal band 42 is not displaced or slightly displaced transversely, each edge of the inner seal band 42 is located on the transverse inner surface 62. On the contrary, once the inner seal band 42 is displaced transversely by one half of the difference between the distance between the wall surfaces 64 and the width of the inner seal band 42, the edge is received by the wall surface 64 and prevented from being further displaced transversely.

Furthermore, in the case where each edge of the inner seal band 42 is located on the transverse inner surface 62, the inner seal band 42 is at a distance E from the inner opening 58 of the transverse inner surface 62 and permitted to be bent upward (toward the slit 12) under the fluid pressure, if any, from inside. Further, even in the case where the edge is received and stopped by the wall surface 64, the distance I is kept from the transverse inner surface 62, so that the inner seal band 42 is permitted to be bent outward.

[Effects]

The rodless cylinder 1 described above, which includes a cylinder tube 2 formed of an inner hole 10 and a slit 12 parallel to the length of the cylinder tube 2 and communicating with the inner hole 10, further comprises:

an inner moving unit 32 arranged in the inner hole 10 of the cylinder tube 2 and movable along the length of the cylinder tube 2;

an outer moving unit 30 coupled to the inner moving unit 32 by a connector 34 extending through the slit 12 and arranged on the outside of the cylinder tube 2; and an inner seal band 42 extending along the slit 12 to close the slit 12 from inside the inner hole 10;

wherein the longitudinal ends of the inner seal band 42 are restricted so that the intermediate portion of the inner seal band 42 is passed through the inner moving unit 32;

wherein a band accommodating depression 60 having a transverse inner surface 62 extending substantially along the width of the slit 12 and a wall surface 64 inclined at an angle to the transverse inner surface 62 is formed on each side of the inner opening of the slit 12;

wherein the cross section of each of the transverse inner surfaces 62 is an arcuately curved surface with the center of curvature thereof located at a position nearer to the corresponding transverse inner surface 62 than the center of the slit 12;

wherein the band accommodating depression 60 is formed in such a manner that in the case where one of the transverse end portions of the inner seal band 42 comes into contact with one of the wall surfaces 64, the other transverse end portion of the inner seal band 42 comes into contact with the other transverse inner surface 62 and the inner seal band 42 and the inner opening of the slit 12 are in predetermined spaced relation with each other; and wherein the fluid introduced into the cylinder tube with the slit 12 closed by the inner seal band 42 acts on the inner moving unit 32 thereby to move the inner moving unit 32.

According to the first aspect of the invention, even in the case where the fluid is introduced and one of the transverse end portions of the inner seal band 42 comes into contact with the transverse inner surface 62 while the other transverse end portion comes into contact with the corresponding wall surface 64, the inner seal band 42 can be bent toward the slit 12 in a predetermined range.

Specifically, in the normal case where the inner seal band 42 is not displaced or slightly displaced transversely, each transverse inner surface 62 with an arcuate section having the center at the center of curvature O receives the edge of the inner seal band 42. Further, even in the case where the inner seal band 42 is displaced transversely, the edge is guided in such a manner that the inner seal band 42 takes a proper posture to hold the hermeticity against the slit 12. As a result, the edge can be prevented from cutting in the band accommodating depression 60 (inner hole 10). Incidentally, even in normal case, the distance E is set between the inner seal band 42 and the lower opening 58 of the slit 12. Therefore, at the time of introducing the fluid, the inner seal band 42 can be bent toward the slit 12 under the fluid pressure, and pressed against each transverse inner surface 62. Thus, the transverse displacement of the inner seal band 42 is prevented.

Further, even in the case where the inner seal band 42 is displaced by a set amount transversely and the edge reaches the wall surface 64, the wall surface 64 receives the edge, and therefore, the further transverse displacement of the inner seal band 42 is prevented. In the process, the other edge is located on the transverse inner surface 62, and therefore, the hermeticity of the inner seal band 42 can be held, thereby preventing the fluid from leaking from the slit 12. Furthermore, the distance I is set between the inner seal band 42 and the inner opening 58 of the slit 12, and the inner seal band 42 is bent toward the slit 12. Even in the aforementioned case, therefore, the inner seal band 42 is pressed upward, and prevented from being displaced transversely. In this way, the fluid acts positively on the moving unit 4 and moves the moving unit accurately.

Furthermore, each wall surface 64 is formed as a slope farther from the center line of the slit 12, the nearer to the center of the tube 4. Therefore, even in the case where the inner seal band 42 is displaced under the moment imposed thereon, the edge is not easily comes in touch with the lower portion of the wall surface 64. Thus, the edge is positively received, and the wear of the band accommodating depression 60 and the edge including the wall surface 64 can be prevented.

Further, the wall surface 64 has an inclination angle F and a slope length G sufficient to prevent the edge of the inner seal band 42, which may be displaced transversely and come into contact with the corresponding wall surface 64, from riding over the wall surface 64. Therefore, the band accommodating depression 60 can be formed in a simple shape capable of receiving the edge. Thus, the band accommodating depression 60, the inner hole 10 and the tube 2 can be formed easily.

<Second Embodiment>

Figure 7:
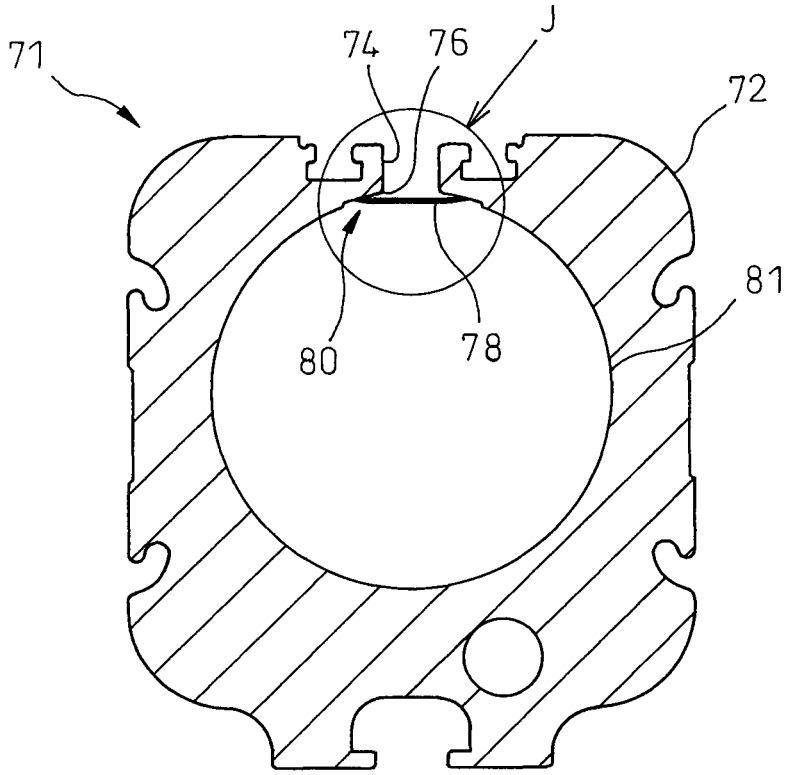
FIG. 7 is a diagram corresponding to FIG. 4 showing the rodless cylinder 71 according to a second embodiment.
Figure 8:
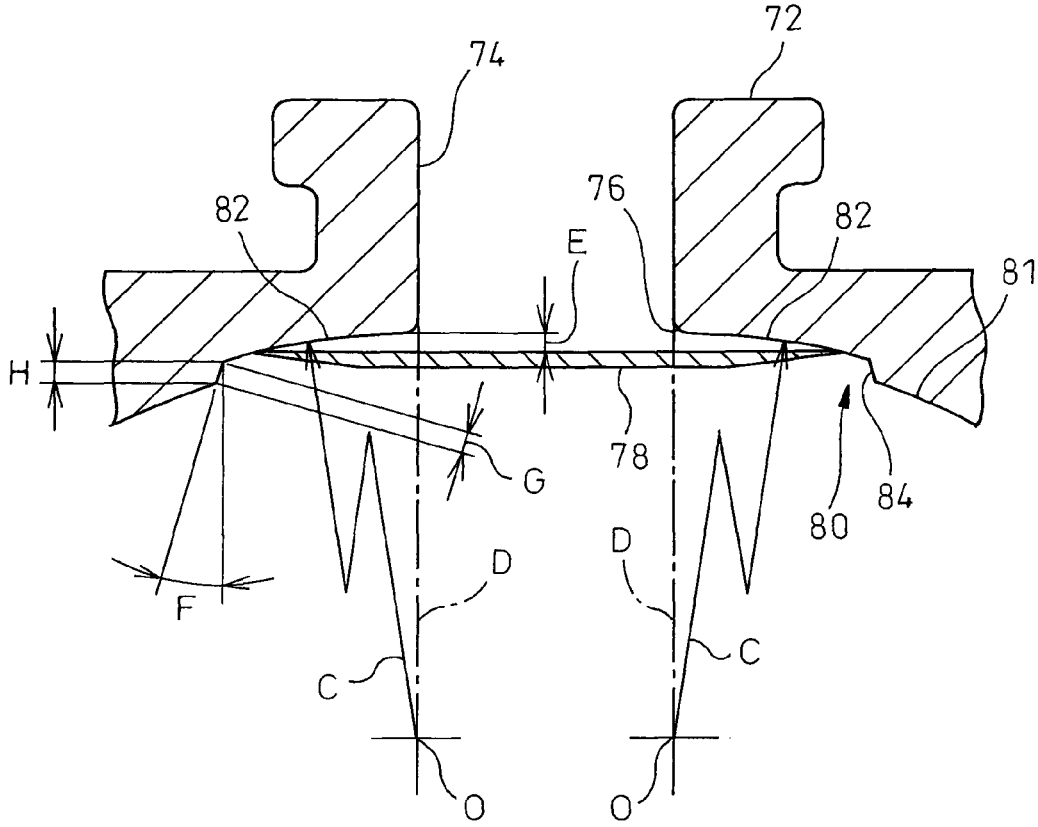
FIG. 8 is an enlarged view a part J in FIG. 7.

FIG. 7 is a diagram corresponding to FIG. 4 showing the rodless cylinder 71 according to a second embodiment, and FIG. 8 an enlarged view of the part J in FIG. 7. The rodless cylinder 71 is formed similarly to that of the first embodiment except for the tube 72. The tube 72 has a longitudinal slit 74, and on each side of the inner opening 76 thereof, includes a band accommodating depression 80 adapted to accommodate the inner seal band 78 and an inner hole 81 having a circular section other than the band accommodating depression 80. Incidentally, the inner portion of the moving unit is in the shape corresponding to the inner hole 81.

The band accommodating depression 80 is formed in a similar way to the first embodiment and includes a transverse inner surface 82 and a wall surface 84 on both sides thereof. In the description that follows, similar component elements to those of the first embodiment are designated by the same reference numerals, respectively. Each transverse inner surface 82 is a curved surface having an arcuate section with a large radius of curvature C, and the center of curvature O is located nearer to the corresponding transverse inner surface 82 than to the vertical surface containing the center line of the slit 74. For example, the center of the curvature O is located in the plane D containing the surface constituting the slit 74. The total width of the two transverse inner surfaces 82 and the slit 74 is larger than the width of the inner seal band 78. In the case where the center of the inner seal band 78 coincides with the center of the slit 74, a distance E is set between the inner opening 76 of the slit 74 and the inner seal band 78.

Each wall surface 84 crosses the transverse inner surface 82, and forms a slope at an inclination angle F to the vertical surface. Each wall surface 84 is formed as a slope farther from the center line of the slit 7, the nearer to the center of the tube 72. Furthermore, each wall surface 84 has a predetermined slope length G from the crossing line of the transverse inner surface 62 and a predetermined rise amount H. Each wall surface 84 is formed in such a manner as to receive the edge of the inner seal band 42 transversely displaced and not to ride over the wall surface 84. The band accommodating depression 80 is formed in such a manner that as long as the wall surface 84 receives one of the edges of the inner seal band 78, a distance is secured (slightly) between the other edge of the inner seal band 78 and the inner opening 76 of the slit 74. This distance and the distance E are set in accordance of the amount of bending of the inner seal band 78 toward the slit 74 under the fluid pressure.

The distance between the wall surfaces 84 is larger than the width of the slit 74. This distance is determined to such a degree that in the case where one of the edges of the inner seal band 78 reaches the wall surface 84, the other edge remains on the transverse inner surface 82. The distance between the wall surfaces 84 is determined in a way permitting the inner seal band 78 to be displaced transversely by such a set amount as not to come off.

The rodless cylinder 71 according to the second embodiment includes a band accommodating depression 80 similar to that of the first embodiment. Therefore, like in the first embodiment, the transverse deviation, posture and bending of the inner seal band 78 are controlled by the band accommodating depression 80, and thus the inner seal band 78 and the band accommodating depression 80 can be protected. Further, also according to the second embodiment, the very high hermeticity of the band accommodating depression 80 can be kept and the moving unit can be accurately moved.

<Modification>

Incidentally, in other embodiments of the invention as modifications of the embodiments described above, the section of the inner hole of the tube or the inner portion may be elliptical. Furthermore, the wall surface of the band accommodating depression may be perpendicular to transverse inner surface or the inner seal band in normal use. Furthermore, the edge of the inner seal band may have the same thickness as the central portion.

This invention is explained above with reference to typical embodiments, and it will be understood to those skilled in the art that this invention can be variously modified, omitted or added in other ways without departing from the scope of the invention.

Description of Reference Numerals

1, 71 Rodless cylinder
2, 72 Tube (cylinder tube)
4 Moving unit
10, 81 Inner hole
12, 74 Slit
32 Inner portion
42, 78 Inner seal band
58, 76 Inner opening
60, 80 Band accommodating depression
62, 82 Transverse inner surface
64, 84 Wall surface
F Inclination angle
G Slope length

The invention claimed is:

1. A rodless cylinder comprising:

a cylinder tube including an inner hole and a slit parallel to the length of the cylinder tube and communicating with the inner hole;

an inner moving unit arranged in the inner hole of the cylinder tube and movable along the length of the cylinder tube;

an outer moving unit coupled to the inner moving unit by a connector extending through the slit and arranged on the outside of the cylinder tube; and an inner seal band extending along the slit to close the slit from inside the inner hole;

wherein longitudinal ends of the inner seal band are restricted so that the inner moving unit passes through an intermediate portion of the inner seal band;

wherein a band accommodating depression having a transverse inner surface substantially extending in a direction of a width of the slit and a wall surface inclined at an angle to the transverse inner surface is formed on each side of an inner opening of the slit;

wherein the cross section of each of the transverse inner surfaces is an arcuately curved surface having the center of curvature located at a position nearer to the corresponding transverse inner surface than a center of the slit;

wherein the band accommodating depression is formed in such a manner that in the case where one of transverse end portions of the inner seal band comes into contact with one of the wall surfaces, the other transverse end portion of the inner seal band comes into contact with the other transverse inner surface and a predetermined distance is set between the inner seal band and the inner opening of the slit;

wherein the fluid introduced into the cylinder tube with the slit closed by the inner seal band acts on the inner moving unit thereby to move the inner moving unit; and wherein each of the wall surfaces is formed as a slope farther from the center line of the slit, the nearer to the center of the cylinder tube.

2. The rodless cylinder of claim 1, wherein the wall surface has an inclination angle and a slope length sufficient not to be ridden over by the transverse end portion in the case where the inner seal band is displaced transversely and the transverse end portion comes into contact with the corresponding wall surface.

* * * * *